US009962725B1

(12) United States Patent
Ko

(10) Patent No.: US 9,962,725 B1
(45) Date of Patent: May 8, 2018

(54) SOUND LOCALIZATION PERFUME NOZZLE ASSEMBLY

(71) Applicant: JIN-JIAN ENTERPRISE CO., LTD., Taoyuan (TW)

(72) Inventor: Chuan-Wei Ko, Taoyuan (TW)

(73) Assignee: JIN-JIAN ENTERPRISE CO., LTD., Taoyuan (TW)

( * ) Notice: Subject to any disclaimer, the term of this patent is extended or adjusted under 35 U.S.C. 154(b) by 15 days.

(21) Appl. No.: 15/345,496

(22) Filed: Nov. 7, 2016

(51) Int. Cl.
*B05B 15/00* (2018.01)
*B05B 1/30* (2006.01)
*B05B 11/00* (2006.01)

(52) U.S. Cl.
CPC ..... *B05B 15/00* (2013.01); *B05B 1/30* (2013.01); *B05B 11/3042* (2013.01)

(58) Field of Classification Search
CPC ..... B05B 15/00; B05B 11/3042; B05B 1/30
See application file for complete search history.

(56) References Cited

U.S. PATENT DOCUMENTS 6,036,109 A * 3/2000 DeYoung ..... B05B 7/0815 239/301
7,708,212 B1 * 5/2010 Conn ..... E04H 4/169 239/589
7,757,964 B2 * 7/2010 Hansson ..... B05B 7/025 138/104
7,819,338 B1 * 10/2010 Goettl ..... E04H 4/169 239/204
8,210,497 B2 * 7/2012 Ko ..... B05B 11/0029 137/614.11
8,297,539 B2 * 10/2012 Ko ..... B05B 11/06 239/333
2007/0262169 A1 * 11/2007 Wang ..... B05B 7/066 239/290

* cited by examiner

*Primary Examiner* — Arthur O Hall
*Assistant Examiner* — Steven M Cernoch

(57) ABSTRACT

A sound localization perfume nozzle assembly includes an accumulator, a nozzle head set, and a sound localization device set between the accumulator and the nozzle head set and including a positioning member and a position-limiting member mounted in the positioning member in such a manner that rotating the nozzle head set causes rotation of the position-limiting member in the positioning member, and a click sound can be produced when one of two opposing abutment edges of the position-limiting member is abutted against the positioning member to stop the nozzle head set in an ON or OFF position, avoiding over rotation to cause nozzle head damage.

5 Claims, 11 Drawing Sheets

A-A

SOUND LOCALIZATION PERFUME NOZZLE ASSEMBLY

BACKGROUND OF THE INVENTION

1. Field of the Invention

The present invention relates to perfume nozzle technology and more particularly, to a sound localization perfume nozzle assembly, which comprises a sound localization device consisting of a positioning member and a position-limiting member and mounted between an accumulator and a nozzle head set for generating a click sound when the user rotates the nozzle head set relative to the accumulator to an ON or OFF position, avoiding over rotation to cause nozzle head damage.

2. Description of the Related Art

There are known perfume bottles with a rotary nozzle head that is rotatable between an open position and a close position to avoid spraying of the contained perfume during carrying when the nozzle head is squeezed accidental by an external force. However, this kind of rotary nozzle head has a small size, if the user rotates the rotary nozzle head with an excessive pressure, a nozzle head damage can easily be created, causing the perfume bottle unable to be used normally.

SUMMARY OF THE INVENTION

The present invention has been accomplished under the circumstances in view. It is therefore the main object of the present invention to provide a sound localization perfume nozzle assembly, which creates a sound when the nozzle head reaches the ON or OFF position, avoiding nozzle head damage due to being over rotated.

To achieve this and other objects of the present invention, a sound localization perfume nozzle assembly comprises an accumulator, a nozzle head set and a sound localization device. The accumulator comprises a casing and a pivot shaft mounted in the casing. The pivot shaft has one end thereof extended out of a top surface of the accumulator. The nozzle head set comprises a nozzle head, a tubular connection tip extended from one side of the nozzle head, and a non-circular flange extended around the periphery of the tubular connection tip. The sound localization device comprises a positioning and a position-limiting member. The positioning member is fixedly mounted at the top surface of the casing of the accumulator, comprising an accommodation chamber for accommodating the pivot shaft of the accumulator, a stop block downwardly protruded from a bottom wall of the accommodation chamber and a positioning block protruded from an inner perimeter of the accommodation chamber. The position-limiting member is accommodated in the accommodation chamber of the positioning member, comprising a base portion, an elastically compressible portion spaced around the base portion, an engagement hole defined in the base portion and configured to fit the configuration of the flange of the nozzle head set, a plurality of positioning grooves located on and equiangularly spaced around the periphery of the elastically compressible portion and a position-limiting groove defined in a bottom surface of the elastically compressible portion for receiving the stop block of the positioning member. Further, the tubular connection tip of the nozzle head set is inserted through the engagement hole and connected to the pivot shaft of the accumulator. Rotating the nozzle head set causes the flange of the nozzle head set to move the position-limiting member of the sound localization device to rotate to the extent where the abutment edge of the position-limiting member is abutted against the stop block of the positioning member, the positioning groove of the position-limiting member is moved into alignment with the positioning block of the positioning member and the positioning groove is forced by an elastic restoring force of the elastically compressible portion to strike against the positioning block and to further generate a click sound.

DETAILED DESCRIPTION OF THE PREFERRED EMBODIMENT

Figure 1:
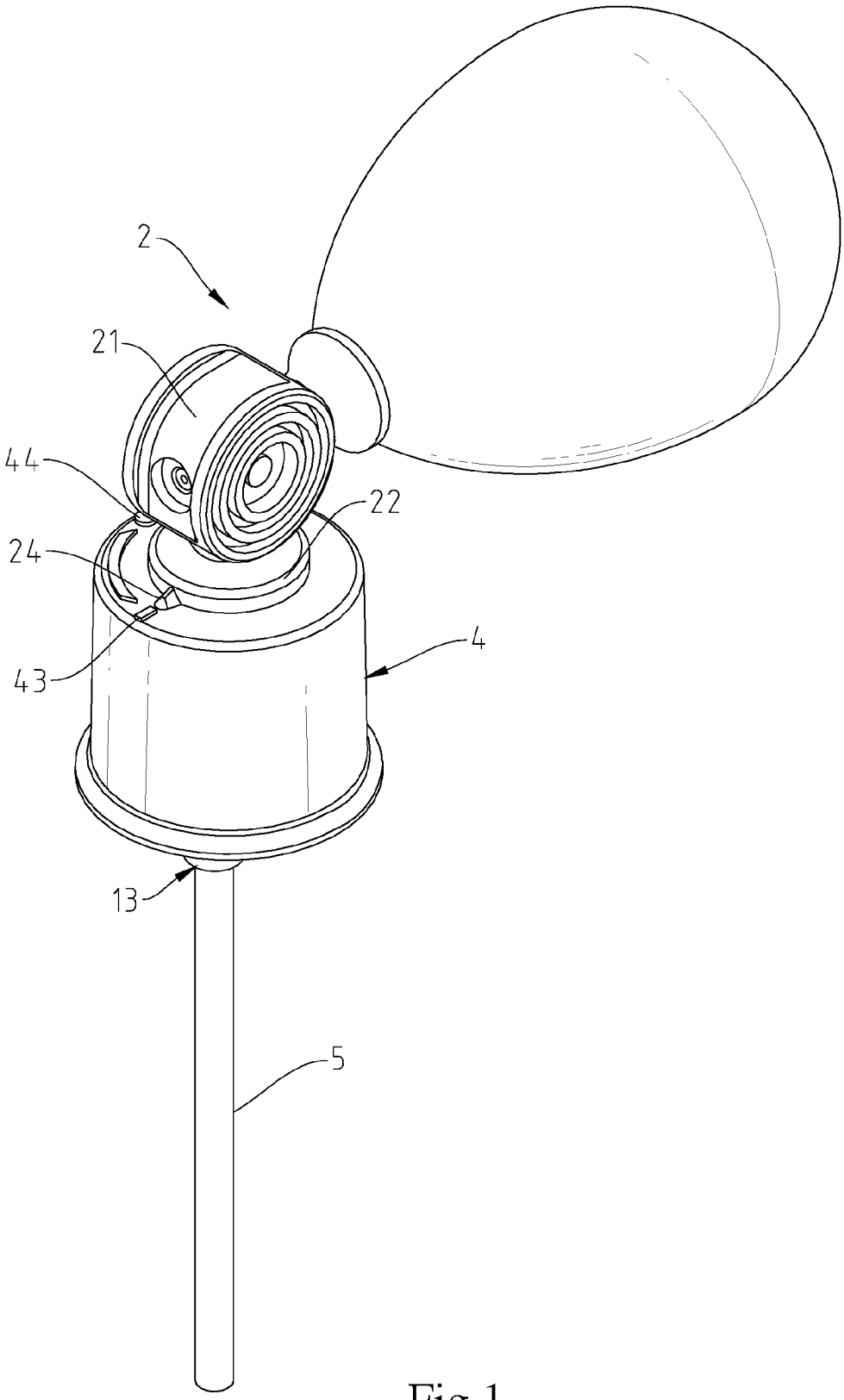
FIG. 1 is an oblique top elevational view of a sound localization perfume nozzle assembly in accordance with the present invention.
Figure 2:
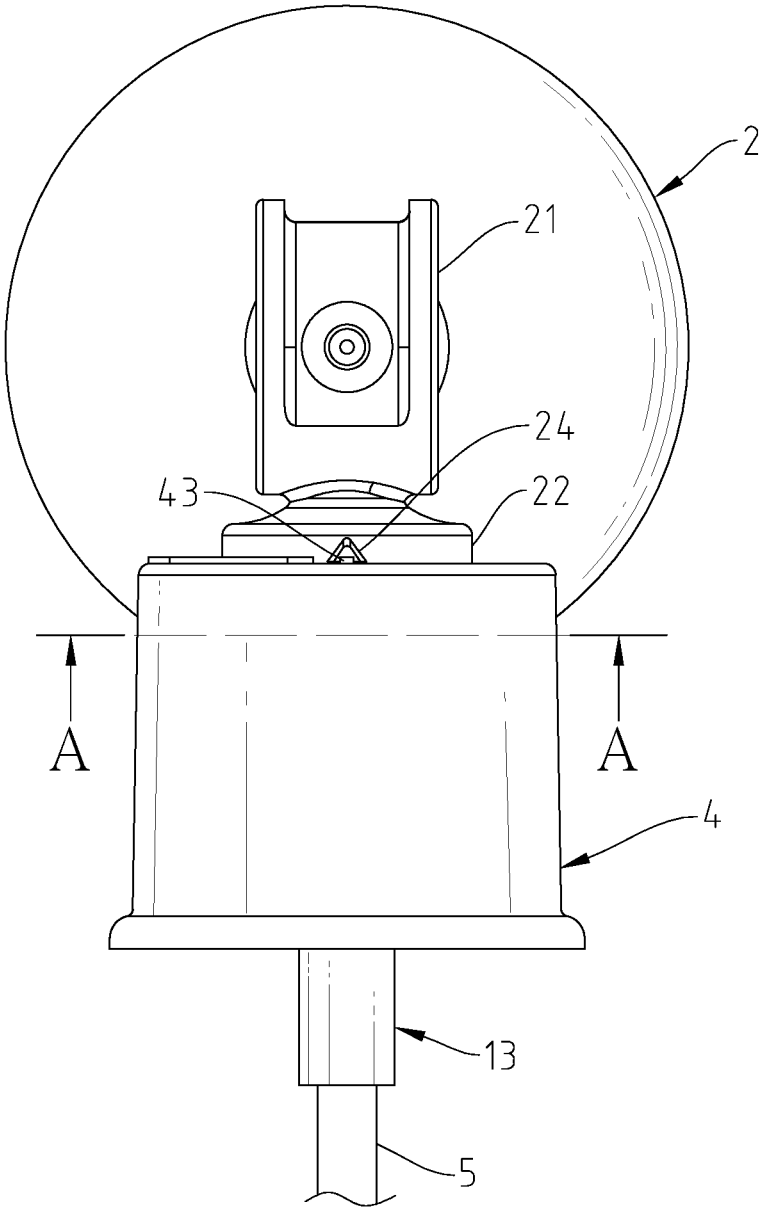
FIG. 2 is a side view of the present invention, illustrating the nozzle head in the ON position.
Figure 3:
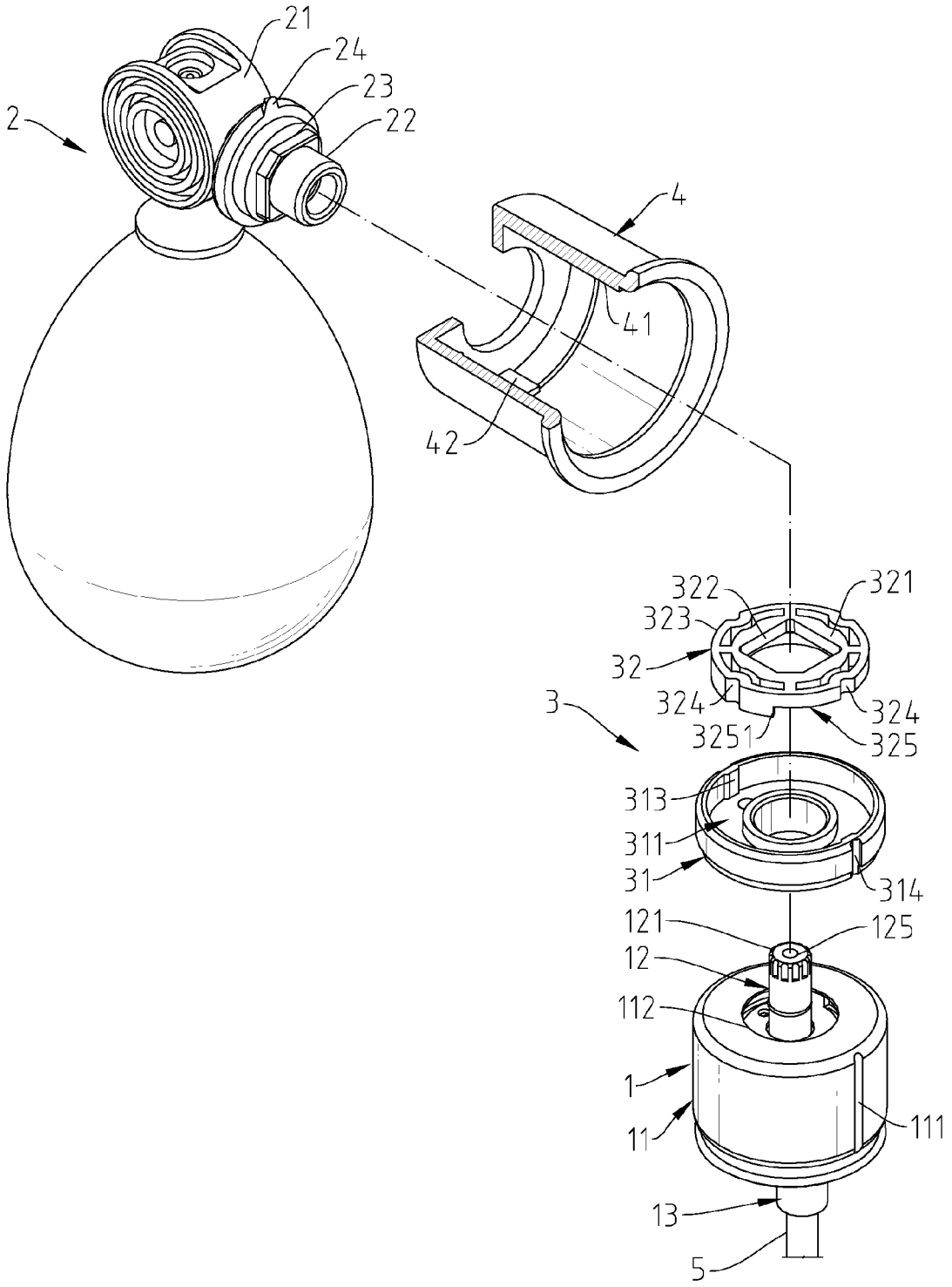
FIG. 3 is an exploded view of the sound localization perfume nozzle assembly in accordance with the present invention.

Referring to FIGS. 1-3, a sound localization perfume nozzle assembly in accordance with the present invention is shown. The sound localization perfume nozzle assembly comprises an accumulator 1, a nozzle head set 2, and a sound localization device 3 set between the accumulator 1 and the nozzle head set 2.

Figure 4:
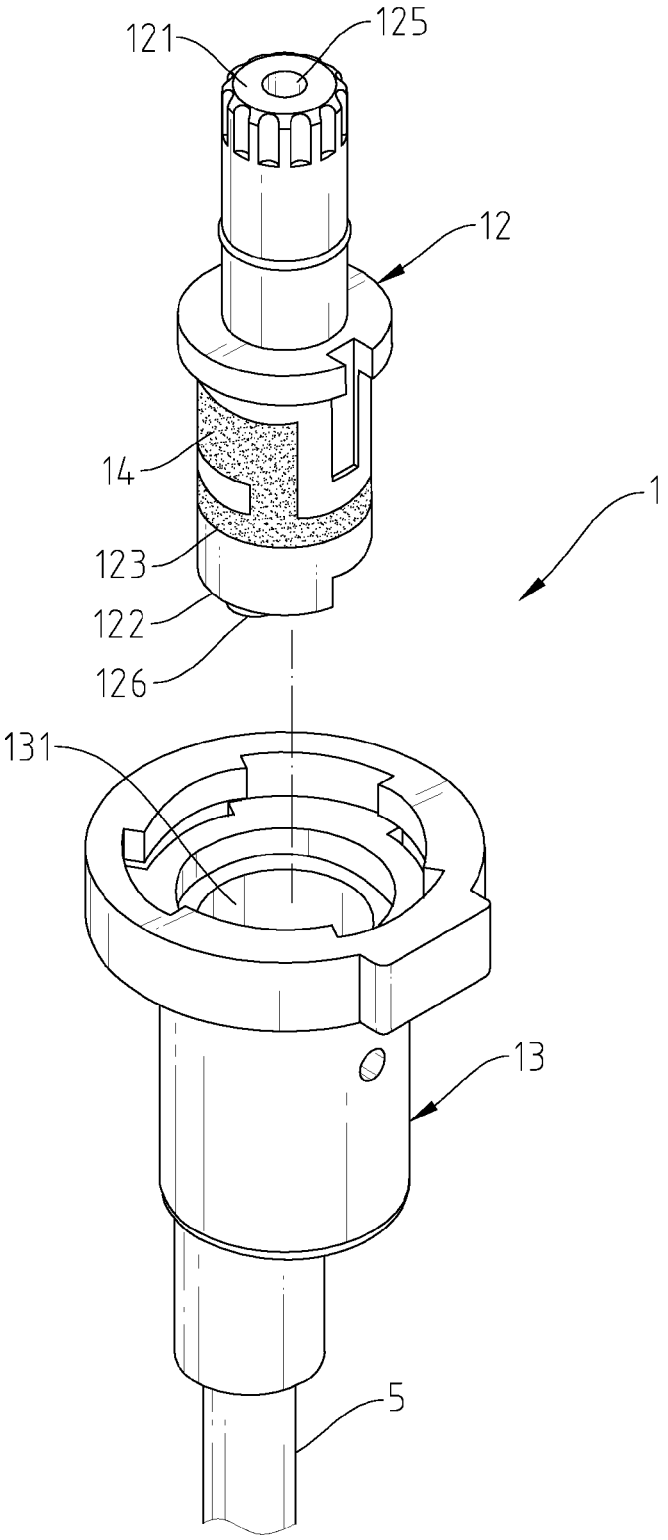
FIG. 4 is an exploded view of the pivot shaft and the pivot shaft holder.
Figure 5:
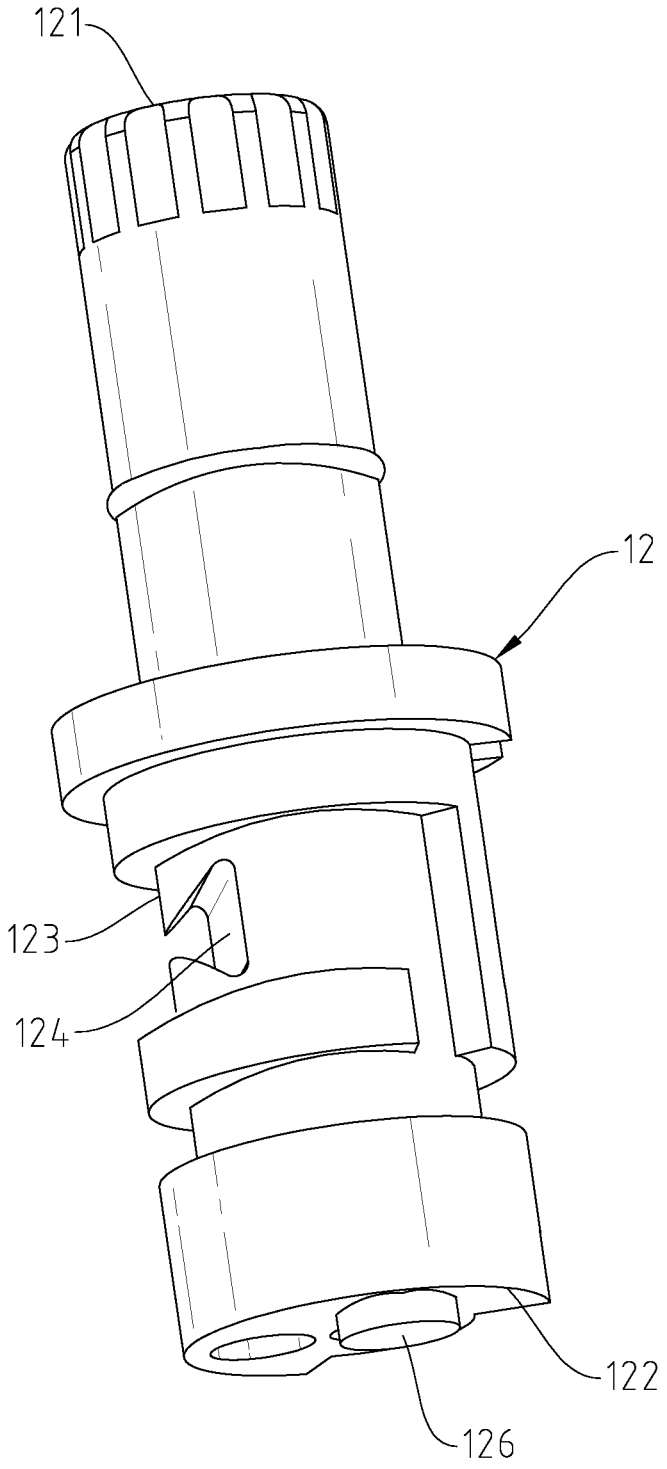
FIG. 5 is an oblique top elevational view of the pivot shaft after removal of the gasket.
Figure 6:
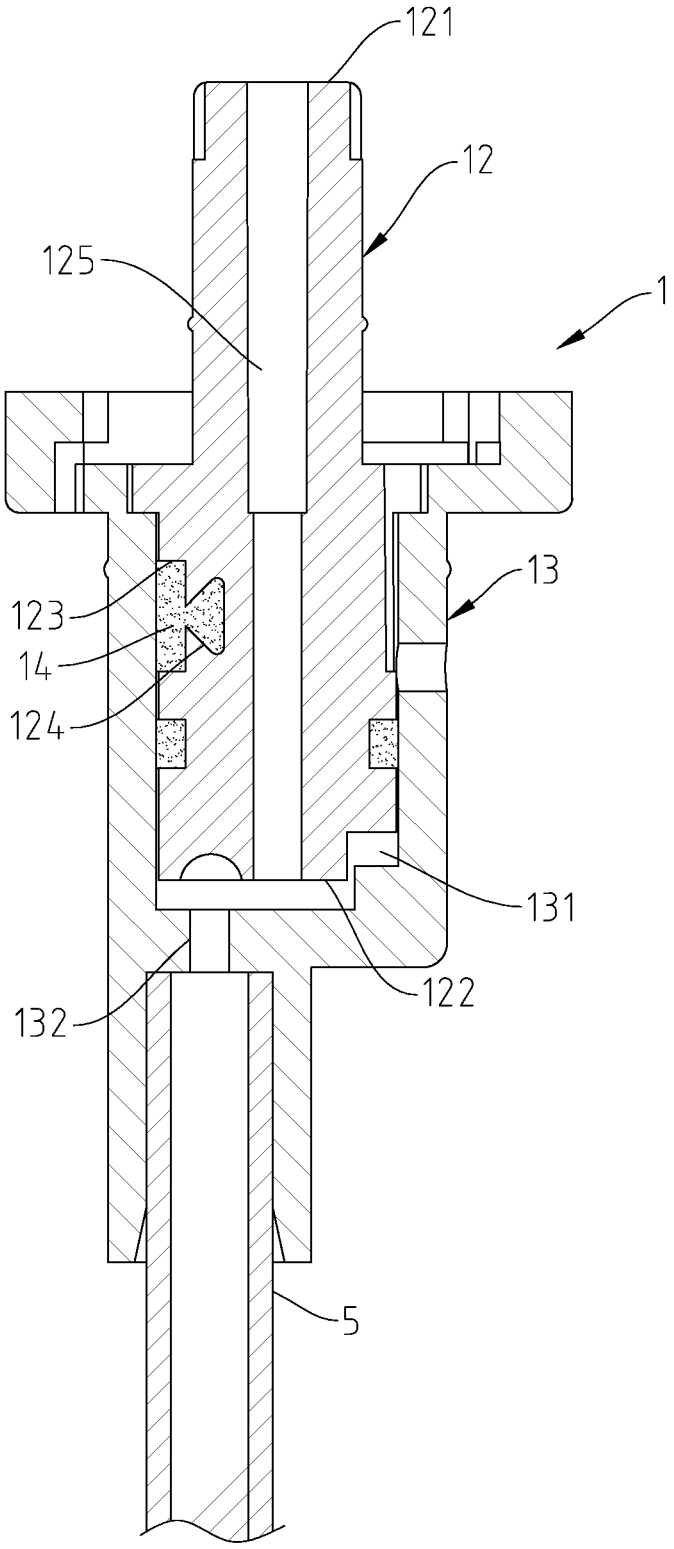
FIG. 6 is a sectional view illustrating the axial center hole of the pivot shaft in communication with the dip tube.

Referring to FIGS. 4-6 and FIG. 3 again, the accumulator 1 comprises a casing 11, a pivot shaft 12, a pivot shaft holder 13 and a gasket 14. The casing 11 comprises a retaining grooves 111 axially located on the periphery thereof at two opposite sides, and a center through hole 112 axially cut through opposing top and bottom surface thereof. The pivot shaft 12 is mounted in the casing 11, comprising a connection end portion 121, a pivoting end portion 122, a recessed portion 123, a axial center hole 125 and a stopper block 126. The connection end portion 121 and the pivoting end portion 122 are respectively located at opposing top and bottom ends of the pivot shaft 12. The connection end portion 121 is inserted through the center through hole 112 and protruded over the top surface of the casing 11 of the top accumulator 1. The pivoting end portion 122 is disposed inside the casing 11 and pivotally coupled to the pivot shaft holder 13. The recessed portion 123 extends around the periphery of the pivoting end portion 122, and has a dovetail groove 124 defined therein. The axial center hole 125 is defined in the pivot shaft 12 and axially extended through the connection end portion 121 and the pivoting end portion 122. The stopper block 126 is located at a bottom surface of the pivoting end portion 122. The pivot shaft holder 13 is mounted inside the casing 11, comprising a coupling hole 131 and a fluid inlet 132. The coupling hole 131 curves inwardly from a top surface of the pivot shaft holder 13. The pivoting end portion 122 of the pivot shaft 12 is pivotally coupled to the coupling hole 131. The fluid inlet 132 is located at a bottom side of the pivot shaft holder 13, having a top end thereof disposed in fluid communication with the coupling hole 131 and an opposing bottom end thereof mounted with a dip tube 5. The gasket 14 is made from a rubber material and bonded to the recessed portion 123 of the pivot shaft 12 and the dovetail groove 124 by injection molding to avoid separation from the pivot shaft 12. After pivotally coupled the pivoting end portion 122 of the pivot shaft 12 to the coupling hole 131 of the pivot shaft holder 13, the gasket 14 is closely abutted against the peripheral wall of the coupling hole 131.

The nozzle head set 2 comprises a nozzle head 21, a tubular connection tip 22 extended from one side of the nozzle head 21, a non-circular flange 23 extended around the periphery of the tubular connection tip 22, and an pointer 24 protruded from the periphery of the tubular connection tip 22 adjacent to the nozzle head 21.

The dip tube 5 is adapted for transferring a perfume from a perfume container (not shown) into the fluid inlet 132 and coupling hole 131 of the pivot shaft holder 13 so that the perfume fluid can be delivered through the axial center hole 125 of the pivot shaft 12 and the tubular connection tip 22 of the nozzle head set 2 and then ejected out of the nozzle head 21 of the nozzle head set 2. Because the gasket 14 is bonded to the pivot shaft 12 and closely abutted against the peripheral wall of the coupling hole 131, the perfume fluid is prohibited from leaking through the surface area between the coupling hole 131 and the pivot shaft 12.

Figure 7:
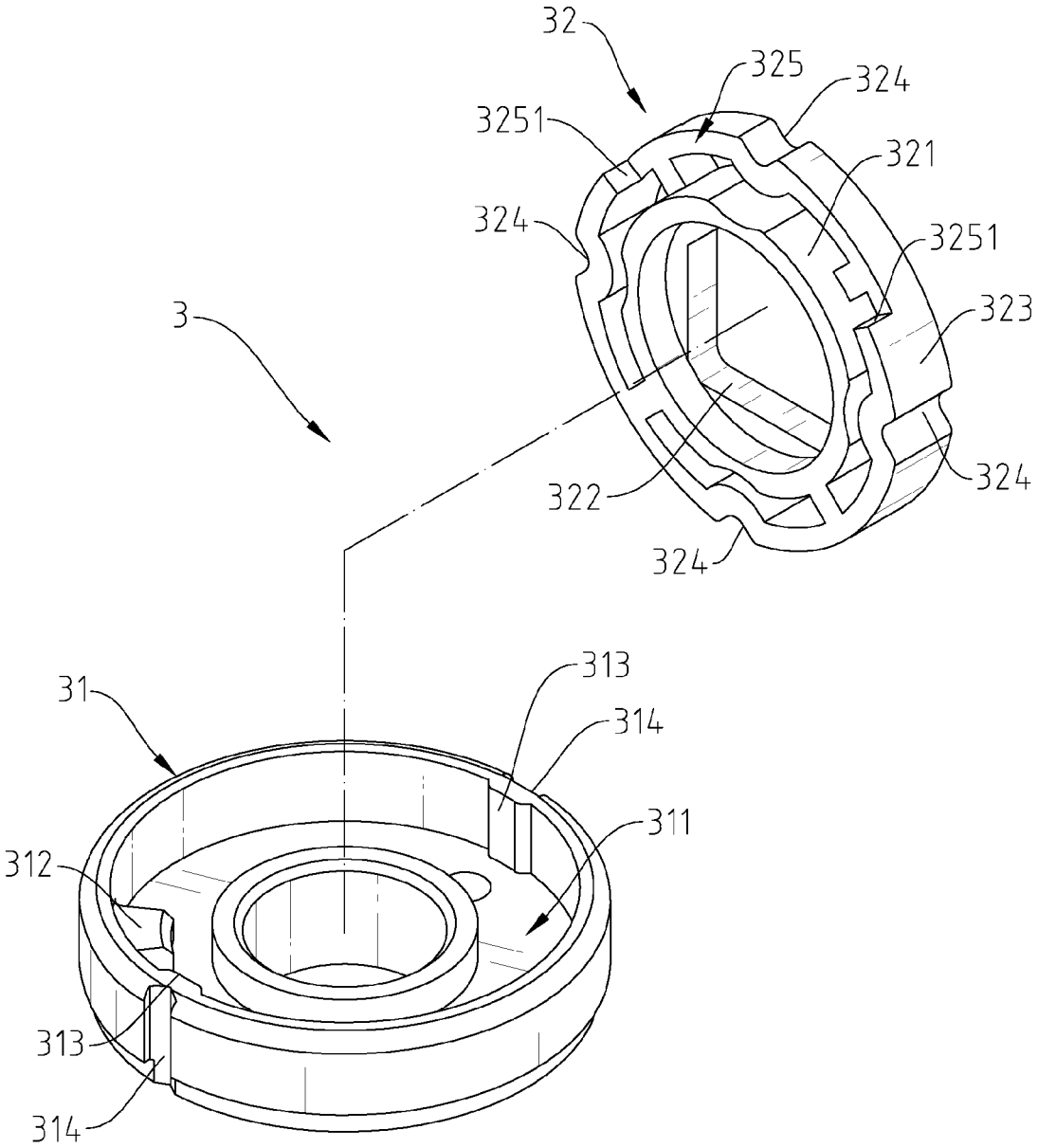
FIG. 7 is an exploded view of the sound localization device.

Referring to FIG. 7 and FIG. 3 again, the sound localization device 3 comprises a positioning member 31 and a position-limiting member 32 The positioning member 31 is fastened to the casing 11 of the accumulator 1, comprising an accommodation chamber 311, a stop block 312, a plurality of positioning blocks 313 and two retaining grooves 314. The accommodation chamber 311 is an open chamber defined in the positioning member 31. The connection end portion 121 of the pivot shaft 12 is inserted through the positioning member 31 and extended out of the accommodation chamber 311. The stop block 312 is located in a bottom side of the accommodation chamber 311. The positioning blocks 313 are equiangularly spaced around an inner perimeter of the accommodation chamber 311. The position-limiting member 32 is accommodated in the accommodation chamber 311 of the positioning member 31, comprising a base portion 321, an engagement hole 322 defined in the base portion 321 configured to fit the outer perimeter of the flange 23 of the nozzle head set 2, an elastically compressible portions 323 spaced around the base portion 321, four positioning grooves 324 located on the outer perimeter of the elastically compressible portion 323 and equiangularly spaced from one another, and a position-limiting groove 325 defined in a bottom side of the elastically compressible portion 323. The position-limiting groove 325 defines two opposing abutment edges 3251 respectively located at two opposite ends thereof. The stop block 312 of the positioning member 31 is disposed in the position-limiting groove 325. The tubular connection tip 22 of the nozzle head set 2 is inserted through the engagement hole 322 and then connected to the pivot shaft 12 of accumulator 1 so that the nozzle head set 2 can be driven to rotate the pivot shaft 12 and the position-limiting member 32.

Figure 8:
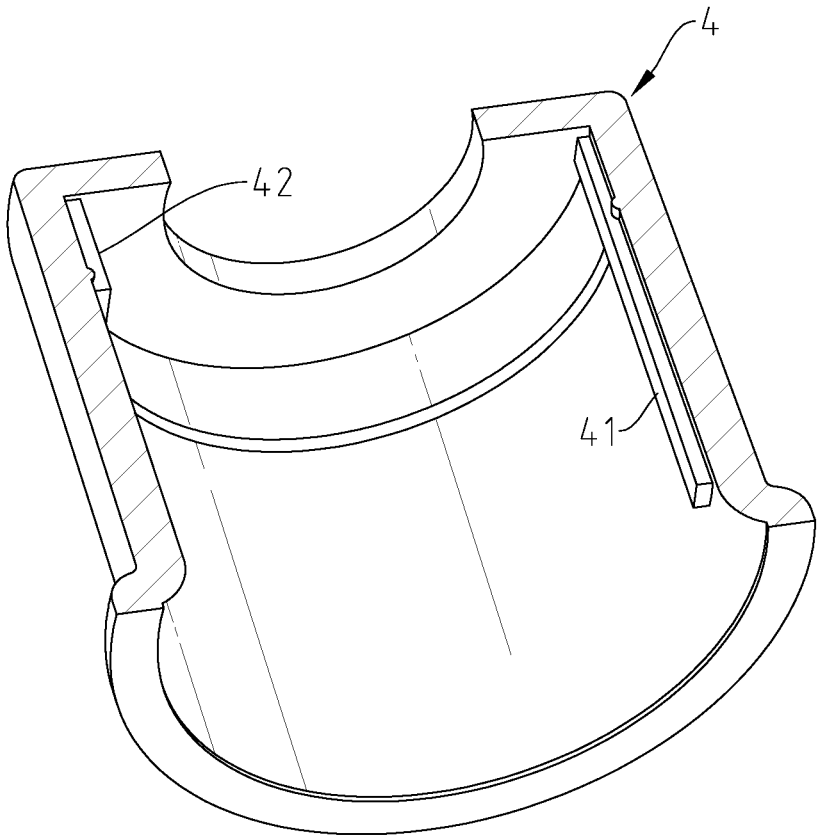
FIG. 8 is a sectional elevation of the cap.

Referring to FIG. 8 and FIG. 3 again, a cap 4 is capped on the accumulator 1 and the sound localization device 3. The cap 4 comprises two engagement ribs 41,42 located on an inside wall thereof at two opposite sides and respectively engaged into the retaining grooves 111 of the casing 11 of the accumulator 1 and the retaining grooves 314 of the positioning member 31 of the sound localization device 3 to secure the cap 4 to the accumulator 1 and the sound localization device 3, and an ON indication sign 43 and an OFF indication sign 44 respectively located at the outer perimeter of the cap 4 for indication by the pointer 24 of the nozzle head set 2 selectively. Thus, the pointer 24 can point out the ON indication sign 43 or OFF indication sign 44, enabling the user to clearly know the nozzle head set 2 in the ON (open) or OFF (close) position.

Figure 9:
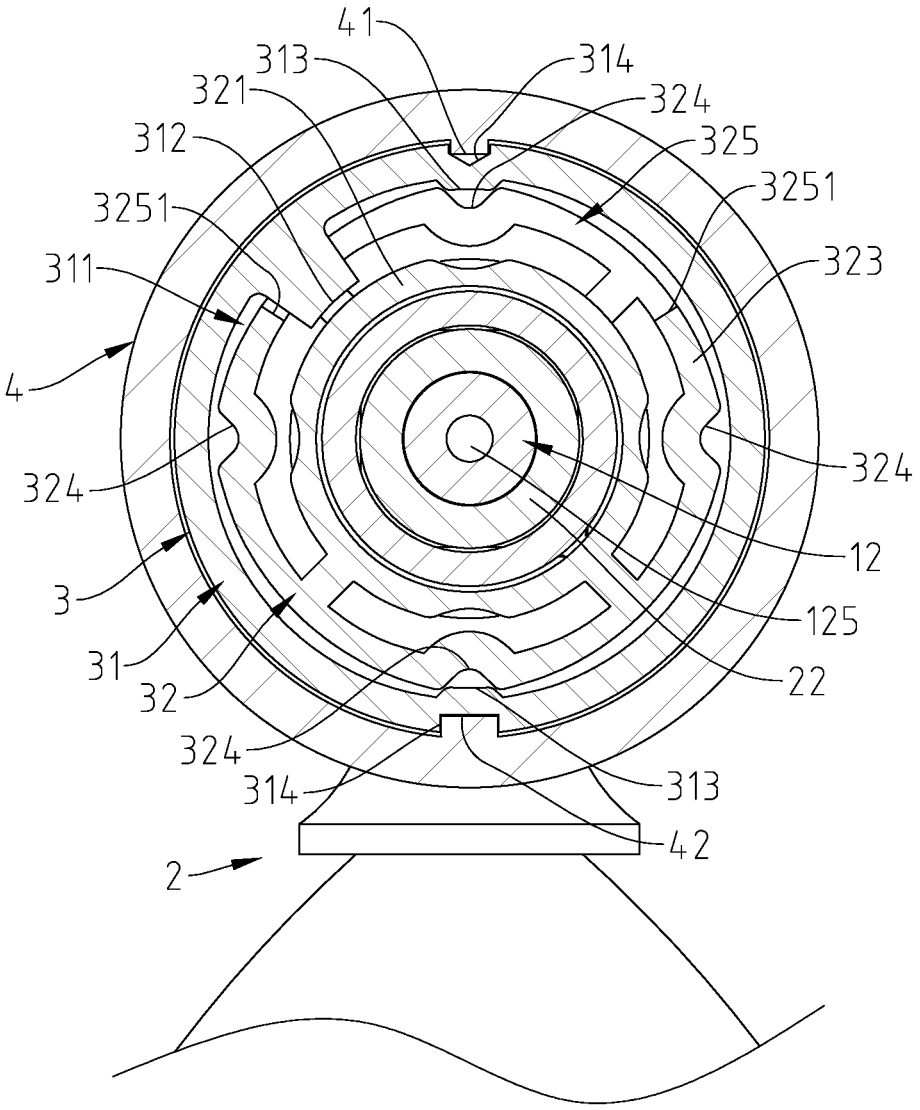
FIG. 9 is an enlarged sectional view taken along line A-A of FIG. 2.

Referring to FIG. 9 and FIGS. 1, 3, 4 and 6 again, when the nozzle head set 2 in the ON (open) position, as illustrated in FIG. 1, the pointer 24 of the nozzle head set 2 is aimed at the ON indication sign 43 of the cap 4, at this time, the stopper block 126 of the pivot shaft 12 is kept away from the fluid inlet 132 of the pivot shaft holder 13 for allowing fluid communication between the axial center hole 125 and the dip tube 5, the abutment edge 3251 of the position-limiting member 32 of the sound localization device 3 is abutted against the stop block 312 of the positioning member 31, and positioning blocks 313 of the positioning member 31 are respectively kept in alignment with one respective positioning groove 324 of the position-limiting member 32.

Figure 10:
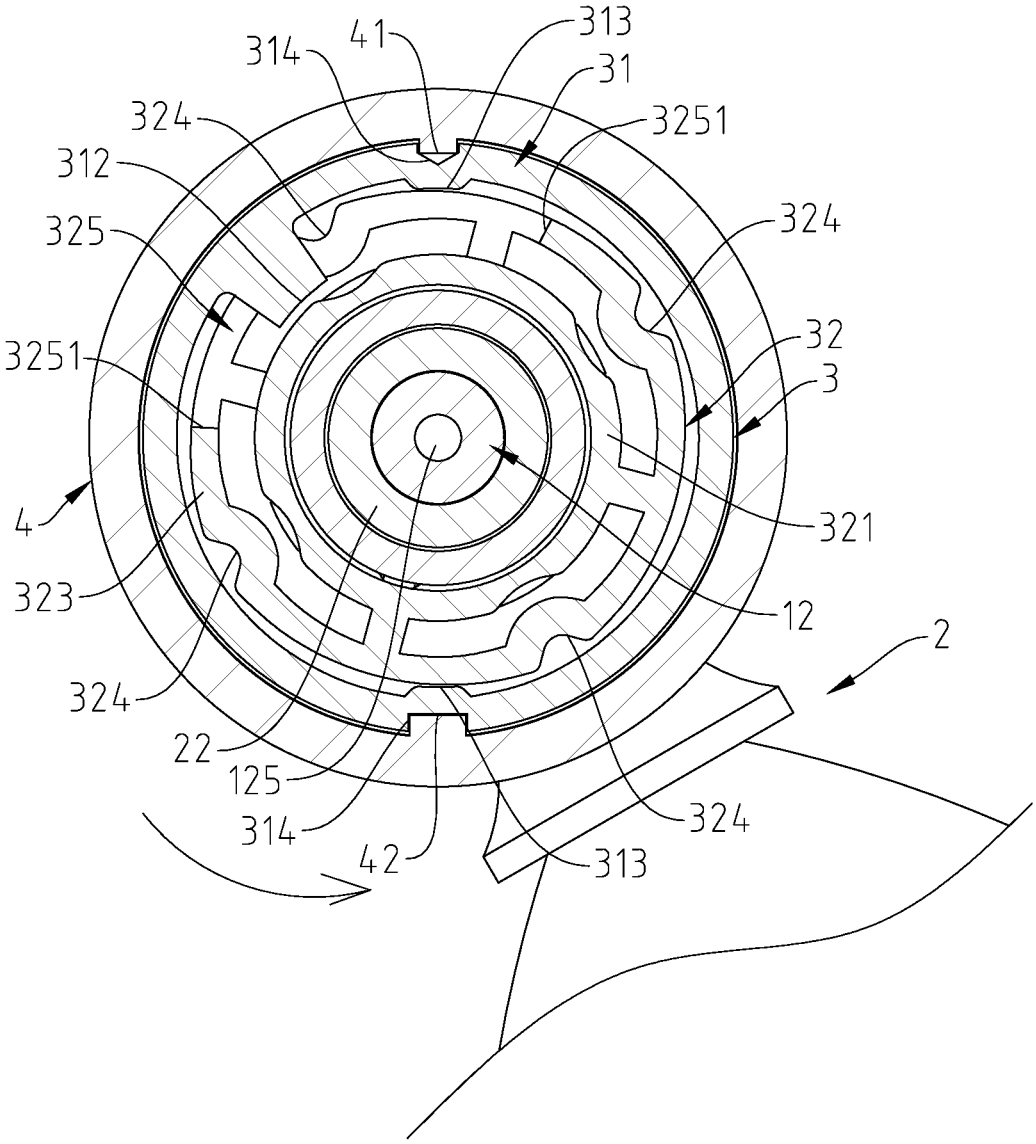
FIG. 10 is a schematic sectional view illustrating the nozzle head of the nozzle head set rotated clockwise.

Referring to FIG. 10 and FIGS. 3, 5 and 6 again, when the user rotates the nozzle head 21 of the nozzle head set 2 clockwise, the flange 23 of the nozzle head set 2 is forced to move the engagement hole 322 of the position-limiting member 32 and the pivot shaft 12, causing rotation of the position-limiting member 32 and the pivot shaft 12 with the nozzle head 21 and movement of the stopper block 126 of the pivot shaft 12 toward the fluid inlet 132 of the pivot shaft holder 13. At this time, the abutment edge 3251 that was abutted against one respective stop block 312 is moved away from the respective stop block 312, the other abutment edge 3251 in the other end of the position-limiting groove 325 is moved toward the respective stop block 312, and, the positioning groove 324 of the position-limiting member 32 is squeezed by the positioning block 313 of the positioning member 31 and elastically deformed. As the position-limiting member 32 is being rotated away from the positioning block 313, the next positioning groove 324 is moved toward the respective positioning block 313.

Figure 11:
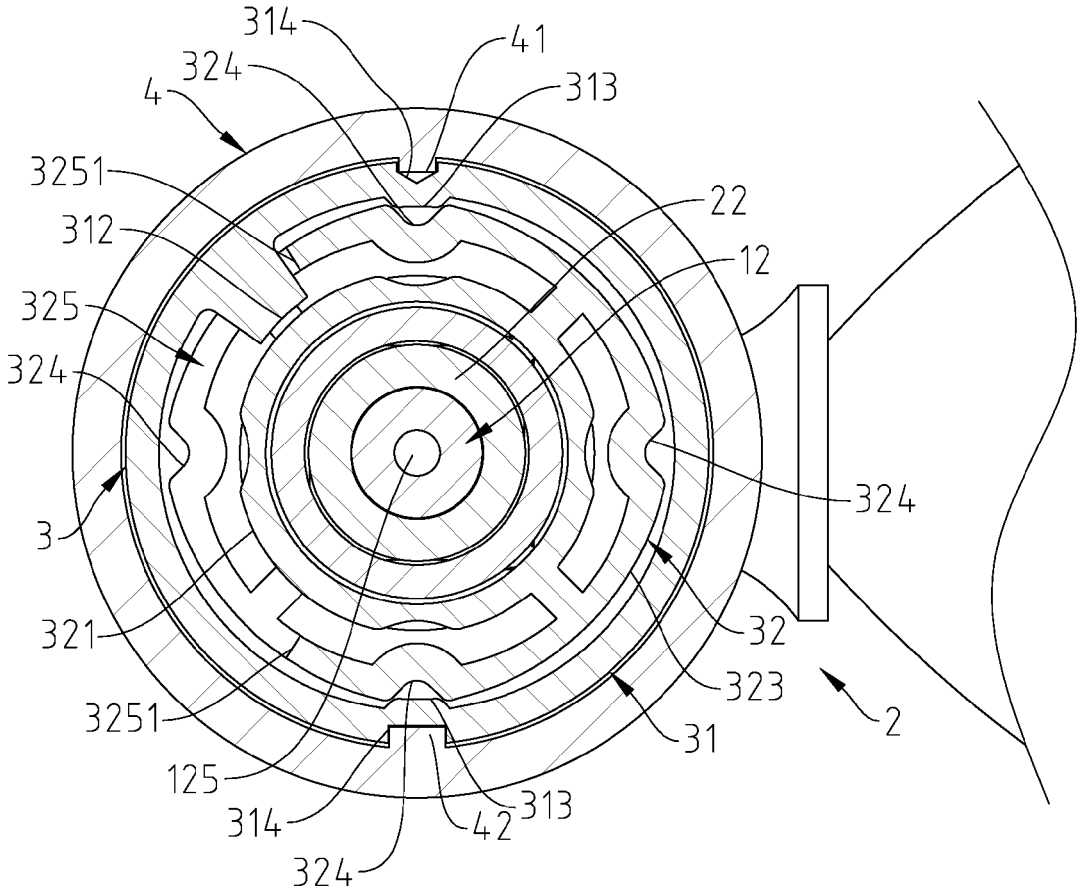
FIG. 11 is a sectional view of the present invention, illustrating the nozzle head in the OFF position.

Referring to FIG. 11 and FIGS. 3, 5 and 6 again, when the user keeps rotating the position-limiting member 32 to move the pointer 24 of the nozzle head set 2 into alignment with the OFF indication sign 44 of the cap 4, the stopper block 126 of the pivot shaft 12 will be attached to the fluid inlet 132 of the pivot shaft holder 13 to block the communication between the axial center hole 125 and the dip tube 5, the abutment edge 3251 moving toward the respective stop block 312 will be abutted against the respective stop block 312, the positioning groove 324 moving toward the respective positioning block 313 will be squeezed against the respective positioning block 313 and elastically deformed to face toward the respective positioning block 313, at this time, the respective positioning groove 324 will be returned to its former shape and forced to strike against the respective positioning block 313 subject to the elastic potential energy of the respective elastically compressible portion 323, causing generation of a click sound.

Thus, if the user needs to open the nozzle head 21, the user can rotate the nozzle head 21 of the nozzle head set 2 counter-clockwise to move the pointer 24 of the nozzle head set 2 into alignment with the ON indication sign 43 of the cap 4, moving the stopper block 126 of the pivot shaft 12 away from the fluid inlet 132 of the pivot shaft holder 13 for allowing communication between the axial center hole 125 and the dip tube 5, at this time, the abutment edge 3251 that was moved away from the respective stop block 312 during clockwise rotation of the nozzle head 21 is moved toward the respective stop block 312 and then abutted against the respective stop block 312, the positioning groove 324 that was moved away from the respective positioning block 313 during clockwise rotation of the nozzle head 21 is moved toward the respective positioning block 313 and then returned to its former shape and forced to strike against the respective positioning block 313 subject to the elastic potential energy of the respective elastically compressible portion 323, causing generation of a click sound.

What the invention claimed is:

1. A sound localization perfume nozzle assembly, comprising:

an accumulator comprising a casing and a pivot shaft mounted in said casing, said pivot shaft having one end thereof extended out of a top surface of said accumulator;

a nozzle head set comprising a nozzle head, a tubular connection tip extended from one side of said nozzle head and a non-circular flange extended around the periphery of said tubular connection tip; and a sound localization device comprising a positioning and a position-limiting member, said positioning member being fixedly mounted at the said top surface of said casing of said accumulator and comprising an accommodation chamber for accommodating said pivot shaft of said accumulator, a stop block downwardly protruded from a bottom wall of said accommodation chamber and a positioning block protruded from an inner perimeter of said accommodation chamber, said position-limiting member being accommodated in said accommodation chamber of said positioning member and comprising a base portion, an elastically compressible portion spaced around said base portion, an engagement hole defined in said base portion and configured to fit the configuration of said flange of said nozzle head set, a plurality of positioning grooves located on and equiangularly spaced around the periphery of said elastically compressible portion and a position-limiting groove defined in a bottom surface of said elastically compressible portion and receiving said stop block of said positioning member;

wherein said tubular connection tip of said nozzle head set is inserted through said engagement hole and connected to said pivot shaft of said accumulator; when rotating said nozzle head set causes said flange of said nozzle head set to move said position-limiting member of said sound localization device to rotate to the extent where said abutment edge of said position-limiting member is abutted against said stop block of said positioning member, said positioning groove of said position-limiting member is moved into alignment with said positioning block of said positioning member and said positioning groove is forced by an elastic restoring force of said elastically compressible portion to strike against said positioning block and to further generate a click sound.

2. The sound localization perfume nozzle assembly as claimed in claim 1, further comprising a cap capped on said accumulator and said sound localization device, wherein said casing of said accumulator comprises a retaining groove located at the periphery thereof; said positioning member of said sound localization device comprises a retaining groove located at the periphery thereof; said cap comprises an engagement rib engaged into the said retaining groove of said casing of said accumulator and the said retaining groove of said positioning member of said sound localization device to secure said accumulator and said sound localization device to said cap.

3. The sound localization perfume nozzle assembly as claimed in claim 1, further comprising a cap capped on said accumulator and said sound localization device, wherein said cap comprises an ON indication sign and an OFF indication sign located at the periphery thereof; said nozzle head set further comprises a pointer protruded from the periphery of said tubular connection tip adjacent to said nozzle head and movable with said nozzle head set to selectively point out one of said ON indication sign and said OFF indication sign.

4. The sound localization perfume nozzle assembly as claimed in claim 1, wherein said accumulator further comprises a pivot shaft holder mounted in said casing; said pivot shaft of said accumulator comprises a connection end portion located at one end thereof and protruded over the said top surface of said casing of said accumulator and a pivoting end portion located at an opposite end thereof and pivotally coupled to said pivot shaft holder in said casing.

5. The sound localization perfume nozzle assembly as claimed in claim 4, wherein said pivot shaft comprises a recessed portion extended around the periphery of said pivoting end portion and a dovetail groove located in said recessed portion; said accumulator further comprises a gasket bonded to said recessed portion and said dovetail groove by injection molding.

* * * * *